US006418598B1

(12) United States Patent
Devos

(10) Patent No.: US 6,418,598 B1
(45) Date of Patent: Jul. 16, 2002

(54) METHOD OF MANUFACTURING AN ELASTIC ALL-FIBER POLYESTER CLOTH

(75) Inventor: Philippe Devos, Changhai (CN)

(73) Assignee: Chargeurs Boisssy, Paris (FR)

( * ) Notice: Subject to any disclaimer, the term of this patent is extended or adjusted under 35 U.S.C. 154(b) by 0 days.

(21) Appl. No.: 09/387,812

(22) Filed: Sep. 1, 1999

(30) Foreign Application Priority Data

Sep. 10, 1998 (FR) ..... 98 11450

(51) Int. Cl.[7] ..... D03D 7/00; D06C 7/00
(52) U.S. Cl. ..... 28/155; 28/165
(58) Field of Search ..... 28/155, 165, 151, 28/156, 167, 169; 139/420 R, 421, 422; 57/243, 248, 246, 208; 442/181, 182, 199; 8/147, 149.1, 149.2, 151

(56) References Cited

U.S. PATENT DOCUMENTS

| | | | | | |
|---|---|---|---|---|---|
| 3,017,685 | A | * | 1/1962 | Heberlein | 28/155 |
| 3,128,528 | A | * | 4/1964 | Magel et al. | 28/155 |
| 3,266,865 | A | * | 8/1966 | Runton | 28/155 |
| 3,316,610 | A | * | 5/1967 | Manock | 139/421 |
| 3,438,842 | A | * | 4/1969 | Petterson et al. | 28/155 |
| 3,486,208 | A | * | 12/1969 | Blythe | 28/155 |
| 3,655,327 | A | * | 4/1972 | Rollins | 28/155 |
| 4,345,385 | A | * | 8/1982 | Sando et al. | 28/155 |
| 5,102,724 | A | * | 4/1992 | Okawahara et al. | 28/155 |
| 5,874,372 | A | * | 2/1999 | Morishita et al. | 28/165 |

FOREIGN PATENT DOCUMENTS

| | | |
|---|---|---|
| GB | 1 446 516 | 8/1976 |

OTHER PUBLICATIONS

Abstract of JP 06 101116.

* cited by examiner

*Primary Examiner*—Amy B. Vanatta
(74) *Attorney, Agent, or Firm*—Wolf, Greenfield & Sacks, P.C.

(57) ABSTRACT

The present invention relates to a method of manufacturing an all-fiber polyester cloth that is elastic, the cloth having a certain proportion of two-component polyester fibers of side-by-side structure suitable for developing helical and spiral crimp. The method comprises the operations of preparing the fiber mixture, spinning, weaving, and applying various treatments to the cloth. The operations of preparing and spinning lead to a non-extensible thread and the weaving is highly decompacted so as to take account of its potential elasticity, the loomstate cloth being subjected to heat pre-treatment in hot air at a temperature lying in the range 180° C. to 190° C. under very low tension, prior to performing any conventional treatment in a liquid medium, and in particular washing and dyeing; in addition during all operations subsequent to the heat pre-treatment, tension on the cloth is limited. For example, the dry heat pre-treatment consists in passing through a stenter for a duration of 1 min to 1.5 min approx., at a temperature of about 185° C. An approximately 50/50 polyester/wool mixture in which all of the polyester fibers are of side-by-side structure, the passage through the stenter takes place with a stenter advance of about 15% and a stenter outlet width adjustment of about 9% smaller than the width of the loomstate cloth.

7 Claims, No Drawings

METHOD OF MANUFACTURING AN ELASTIC ALL-FIBER POLYESTER CLOTH

The present invention relates to an all-fiber polyester cloth having relatively large elastic properties of the order of 15% to 20% and without using elastomeric type materials. More particularly, the invention relates to a method of manufacturing such a cloth implementing two-component polyester fibers having a side-by-side structure suitable for developing helical and spiral crimp. The invention also relates to cloth obtained by said method.

BACKGROUND OF THE INVENTION

The use of textured threads makes it possible to obtain a polyester cloth having a high degree of elasticity, but such use naturally excludes an all-fiber cloth since textured threads are by nature continuous threads. With an all-fiber polyester cloth, elasticity can be conferred by using a certain fraction of elastomeric fibers, and in particular of elastane fibers. Proposals have also been made to use two-component fibers of side-by-side structure, i.e. synthetic fibers having two juxtaposed parts with physical or chemical characteristics that are different, the differences subsequently giving rise to a certain amount of crimping of the fibers. In particular, Rhone-Poulenc Fibres presented a fiber of this type in 1984 under the name X403. It has a side-by-side structure whose two longitudinally-juxtaposed parts are chemically-different polyesters obtained from two different diols. According to the producer, that fiber develops helical and spiral crimping giving it bulk and stretch, like that which is obtained with textured threads, with the exception that the spun fibers, whether pure or mixed, have no stretch; crimping and thus stretch being revealed only during the dyeing or the various heat treatments applied to the cloth. More precisely, Rhone-Poulenc Fibres recommended performing the following succession of operations on the loomstate cloth, namely: washing, heat treatment at 190° C. for about 30 seconds, dyeing at 130° C., chafing after dyeing, stenter drying, brushing/cropping, and finishing.

However, the Applicant has observed that by complying scrupulously with the above-mentioned recommendations, the resulting cloth does not have elasticity of 15% to 20%, as announced.

OBJECTS AND SUMMARY OF THE INVENTION

The object of the Applicant is to propose a method of manufacture that mitigates the above-specified drawback, i.e. that makes it possible under industrial conditions to obtain an all-fiber polyester cloth that is elastic, containing a certain fraction of two-component side-by-side structure polyester fibers, suitable for developing helical and spiral crimp.

In conventional manner, the method comprises operations of preparing the mixture of fibers, of spinning, of weaving, and of applying various treatments to the cloth.

In characteristic manner, the operations of preparing and spinning lead to a non-extensible thread and the weaving is highly decompacted so as to take account of its potential elasticity, the loomstate cloth being subjected to heat pre-treatment in hot air at a temperature lying in the range 180° C. to 190° C. under very low tension, prior to performing any conventional treatment in a liquid medium, and in particular washing and dyeing; in addition during all operations subsequent to the heat pre-treatment, tension on the cloth is limited.

Thus, contrary to the recommendations of the producer, it is imperative, according to the Applicant, for the first heat treatment to which the loomstate cloth is subjected to be heat pre-treatment that is performed dry, any preliminary aqueous treatment in hot water of the washing type being to be avoided insofar as that gives rise to a consequent loss of stretch potential of the two-component fibers in the final product.

The dry heat pre-treatment must be followed by taking precautions during subsequent treatment operations to limit the tension exerted on the cloth.

The dry heat pre-treatment preferably consists in using a stenter for a duration of 1 min to 1.5 min, approx., at a temperature of about 185° C.

With a 50/50 polyester/wool mixture, in which all of the polyester fibers are of the side-by-side structure, the stenter is used with advance of about 15% and with width at the outlet of the stenter being adjusted to be about 9% smaller than the width of the loomstate cloth.

Furthermore, the Applicant has also observed that the operations of preparing the fiber mixture and of spinning can give rise to a loss in the potential stretch of the cloth. With a conventional polyester/wool cloth, there are initial guiding operations on each type of fiber leading to the formation of wool slivers and of polyester slivers; the fibers are mixed starting from these two types of sliver, known as "tops", with a re-combing operation integrated in the spinning.

In a manner characteristic of the invention, the fibers are mixed directly on the card and spinning is free from any re-combing operation.

This particular mode of operation has been found by the Applicant by observing that the re-combing operation while spinning leads to a significant drop in the stretch potential of the cloth if insufficient relaxation time is allowed. In practice, it is difficult to guarantee reliably that such rest time will always be complied with, so it has been found appropriate purely and simply to omit the re-combing operation during spinning by using a different preparation route in which the wool and two-component polyester fibers are mixed on the card at the outlet from a mixer fed with bales of stock fiber.

DETAILED DESCRIPTION OF THE INVENTION

The present invention will be better understood on reading the following description of a preferred embodiment of approximately 50/50 all-fiber polyester cloth in which the polyester fibers are two-component fibers of side-by-side structure that develop helical and spiral crimp.

The two-component fiber of side-by-side structure concerned in the description is the polyester fiber sold under the name X403 by Rhone-Poulenc Fibres. However, the present invention is not exclusive to that particular fiber and can be applied to any two-component polyester fiber of side-by-side structure of the same type, that is suitable for developing helical and spiral crimp, approximating to the natural crimp of wool.

In the traditional circuit for preparing and spinning approximately 50/50 polyester/wool threads, the polyester fibers and the wool fibers are mixed from slivers known as "tops".

To make such tops, the wool fibers and the polyester fibers are subjected to parallel operations, in particular to carding and combing for the wool. Prior to spinning, the mixed tops are re-combed before the operations of doubling on gills, and then passing through the roving frame and finally a continuous spinning machine. In the context of the method of the invention, using two-component polyester fibers of side-by-side structure known as X403, the above-summarized conventional circuit has been replaced so as to avoid the re-combing operation prior to spinning which, as observed by the Applicant, tends to be detrimental to the stretch potential of the polyester fibers in the finished cloth, after the crimp has been revealed. If the conventional circuit as outlined above is used, it is necessary to cause the re-combed sliver to wait for a determined length of rest time in order to obtain good stretchability characteristics in the cloth. If that time is not complied with, then the good characteristics are not achieved. Since the time in question can vary as a function of operating conditions and since in addition such waiting constitutes an unacceptable constraint, the Applicant has defined conditions which are industrially acceptable and which mitigate the above-specified drawback.

In a manner characteristic of the invention, the polyester and the wool are mixed on the card from fibers coming from a mixer, itself fed with stock fibers. The circuit is thus as follows. Pre-mixing is performed in a mixer starting from bales of X403 polyester fibers and of wool fibers. In a preferred specific example, mixing takes place using two kinds of X403 polyester bales of different cuts: some fibers of 80 cut and others of 105 cut. The mixer has means for working the material, e.g. a beating comb, weighing means, and transport means enabling the card to be fed with polyester fibers and wool fibers in the appropriate proportion. The fibers are subjected to successive operations of carding and combing leading to the formation of tops, and then to operations of doubling on gills, passing through a roving frame, and then through a continuous spinning machine.

At this stage, the resulting thread has no stretch, since the crimping of the X403 polyester has not yet been revealed. However, weaving operations must take account of the potential stretch of the finished cloth. During weaving, the cloth must be highly decompacted so as to leave room for the large amount of shrinking to which the threads will subsequently be subjected while the crimp is being revealed.

In a specific embodiment, the plain weave cloth was made using 2/70 Nm (286 dtex) threads for both warp and weft. Its weft had 19.5 picks/cm (instead of the usual 23 picks/cm) and its warp had 3485 threads for a width of 180 cm (instead of the usual 4100 threads). The cloth was therefore decompacted by about 17.6% in both the warp and the weft directions, given that the desired stretch was to be about 15% to 17%.

Being highly decompacted, the loomstate cloth needed to be handled with care during subsequent operations, particularly while being unrolled.

In a manner characteristic of the invention, the loomstate cloth must necessarily be subjected to dry heat pre-treatment in the form of passing through a stenter at a temperature lying in the range 180° C. to 190° C., and preferably 185° C. It is during this heat pre-treatment that the helical and spiral crimp of the X403 polyester fibers develops. The cloth draws in by 6% to 8%. The passage through the stenter in question was performed with a minimum tension setting, an advance of 15%, and a width adjustment leading to the width going from about 170 cm for the loomstate cloth to 156 cm on leaving the frame.

Given that the heat pre-treatment is not preceded by the loomstate cloth being washed, it is important to take special care to keep the weaving clean since the pre-treatment could fix certain kinds of dirt.

The heat pre-treatment was followed by conventional operations which do not require special precautions other than minimizing the tensions exerted on the cloth. In particular, the operations were the following:

continuous or discontinuous washing;

dyeing on overflow equipment at about 110° C.;

stenter drying at 130° C.;

first heat treatment on dry cloth at 185° C., the stenter being adjusted with an advance of 15% and a width adjustment so that the cloth was 150 cm wide on leaving the stenter;

cropping;

steaming and relaxing on a vibrating mat;

second dry heat treatment by passing through a stenter at 185° C.; the stenter being adjusted with an advance of 15% and a width adjustment so that the width on leaving the stenter was 145 cm; and decatizing.

It should be observed that stenter drying at 130° C. is considered by the Applicant as being an important step, prior to the first heat treatment, in order to obtain the looked-for good stretch.

The width of the finished cloth was about 142 cm to 143 cm, and it had 15% to 16% stretch in the warp direction and 16% to 17% stretch in the weft direction.

The present invention is not limited to the specific implementation described above by way of non-exhaustive example. It can apply to any all-fiber cloth having types of fiber other than wool mixed with the two-component polyester of side-by-side structure, and also the mixing can be in other proportions.

What is claimed is:

1. A method of manufacturing an all-fiber polyester cloth that is elastic, the cloth having two-component polyester fibers of side-by-side structure suitable for developing helical and spiral crimp, the method comprising the operations of preparing the fiber mixture, spinning, weaving a loomstate cloth, and applying treatments to the cloth, wherein the operations of preparing and spinning lead to a non-extensible thread and the weaving is highly decompacted, the loomstate cloth being subjected to heat pre-treatment in hot air at a temperature lying in the range 180° C. to 190° C. under very low tension, prior to performing any treatment in a liquid medium, and wherein during all operations subsequent to the heat pre-treatment, tension on the cloth is limited.

2. The method according to claim 1, wherein the heat pre-treatment in hot air comprises passing through a stenter for a duration of approximately 1 min to 1.5 min, at a temperature of about 185° C.

3. The method according to claim 2, wherein, for an approximately 50/50 polyester/wool mixture in which all of the polyester fibers are of side-by-side structure, the passage through the stenter takes place with a stenter advance of about 15% and a stenter outlet width adjustment of about 9% smaller than the width of the loomstate cloth.

4. The method according to claim 1, further comprising performing a treatment in a liquid medium, said performing a treatment comprising a dyeing operation and wherein, after the dyeing operation, the cloth is dried by passing through a stenter at 130° C. prior to being subjected to heat treatment at 185° C.

5. The method according to claim 1, wherein the fibers are mixed directly on a card and spinning is free from any re-combing operation.

6. The method according to claim 5, wherein the operations of preparing and spinning comprise making a premixture in a mixer starting from bales of side-by-side structure polyester fibers and of wool fibers, in subjecting the fibers to successive operations of carding and combing leading to the formation of tops, and then to operations of doubling on gills, passing through a roving frame, and then through a continuous spinning machine.

7. The method according to claim 1, wherein, for the highly decompacted weaving operation the number of warp threads and the number of picks are both reduced by about 15% to 20%, compared with a non-decompacted weaving operation.

* * * * *